United States Patent [19]

Meives et al.

[11] Patent Number: 5,072,572

[45] Date of Patent: Dec. 17, 1991

[54] METHOD AND APPARATUS FOR WRAPPING FOLIO REAMS AND THE LIKE

[75] Inventors: Otis Meives, newton; Andrew B. Pritzl, Madison; Charles H. Sauder, Sheboygan, all of Wis.

[73] Assignee: Pemco Inc., Sheyboygan, Wis.

[21] Appl. No.: 487,030

[22] Filed: Feb. 28, 1990

[51] Int. Cl.[5] ..... B65B 11/12

[52] U.S. Cl. ..... 53/209; 53/540; 53/590; 414/788

[58] Field of Search ..... 53/461, 206, 209, 207, 53/590, 540; 198/434; 271/243; 414/788, 789.1, DIG. 907

[56] References Cited

U.S. PATENT DOCUMENTS

| | | | |
|---|---|---|---|
| 3,053,373 | 9/1962 | Cross | 198/434 |
| 3,198,105 | 8/1965 | Smith | 414/907 X |
| 3,213,591 | 10/1965 | Feurstein | 53/76 |
| 3,553,935 | 1/1971 | Woods | 53/209 |
| 3,629,991 | 12/1971 | Sundin | 53/209 |
| 3,724,159 | 4/1973 | Reed | 53/209 X |
| 3,750,361 | 8/1973 | Stevens | 53/209 X |
| 3,886,026 | 5/1975 | Kienel | 53/590 X |
| 3,918,705 | 11/1975 | Koch | 271/293 |
| 3,964,598 | 6/1976 | Alsop | 198/434 X |
| 4,178,118 | 12/1979 | Bailey | 198/434 X |
| 4,189,894 | 2/1980 | Laing | 53/216 X |

*Primary Examiner*—John Sipos

*Attorney, Agent, or Firm*—Peter K. Kontler

[57] ABSTRACT

Folio reams are draped into discrete panels of paper or other wrapping material while in continuous motion along a horizontal path. The panels are fed from below so that the front, lateral and rear portions of each panel extend beyond the respective sides of the corresponding ream. The rear portions of successive panels are folded upwardly against the rear sides and thereupon forwardly against the top sides of the respective reams. The front portions of the panels are provided with films of adhesive and are folded upwardly against the front sides and thereupon rearwardly against the top sides of the respective reams so that their leaders overlie and are adhesively secured to the folded rear portions. The folding of front and rear portions is preceded by squaring of the reams and is followed by tucking and folding of front, rear and lateral portions of successive panels against the adjacent lateral sides of the respective reams.

12 Claims, 6 Drawing Sheets

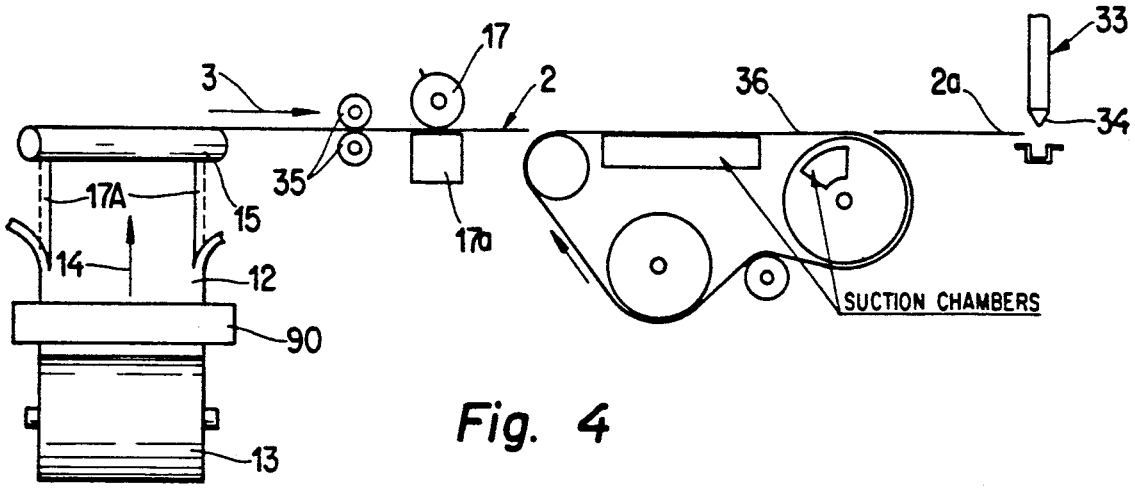
Fig. 4
Fig. 5
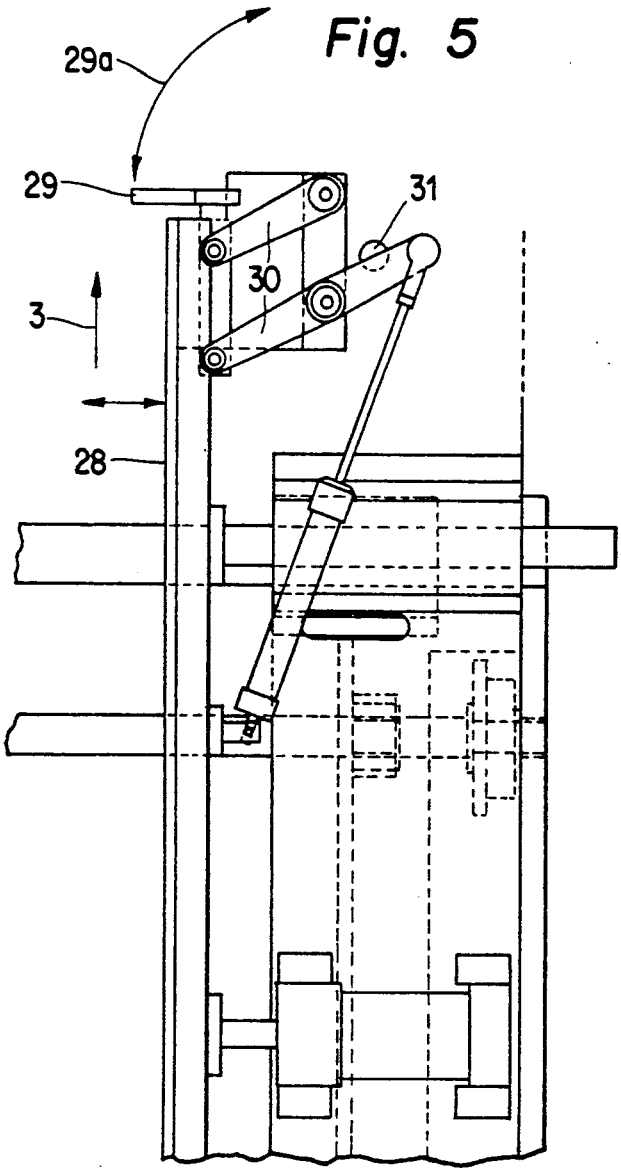

METHOD AND APPARATUS FOR WRAPPING FOLIO REAMS AND THE LIKE

BACKGROUND OF THE INVENTION

The invention relates to methods of and to apparatus for draping block-shaped commodities into panels of paper or other wrapping material. More particularly, the invention relates to improvements in methods of and in apparatus for draping panels of flexible wrapping material around relatively large block-shaped commodities, for example, around so-called folio reams having a length of 20–52 inches, a width of 14–38 inches and a height of ⅝–3½ inches. The following description will deal primarily with the wrapping of folio reams; however, it is to be understood that the method and apparatus of the present invention can be utilized with equal or similar advantage for the wrapping of other substantially block-shaped commodities which may but need not constitute piles or stacks of discrete sheets or groups of sheets of paper, cardboard, metallic foil, plastic foil or the like.

A drawback of presently known folio ream wrapping apparatus is that their output is too low. Moreover, presently known apparatus are incapable of tightly draping the panels of wrapping material around each side of the confined ream. This detracts from the appearance and stability of the wrapped ream. Still further, each change of setup necessitates a prolonged stoppage of a conventional folio ream wrapping apparatus. Thus, there exists an urgent need for an improved folio ream wrapping method and apparatus.

OBJECTS OF THE INVENTION

An object of the invention is to provide a novel and improved method of draping panels of paper or other wrapping material around substantially block-shaped commodities in such a way that each panel closely follows the outline of each and every side of the confined commodity.

Another object of the invention is to provide a method which can be resorted to for wrapping folio reams and analogous block-shaped commodities at a frequency which cannot be achieved with presently known methods.

A further object of the invention is to provide a method which ensures reliable bonding of overlapping portions of draped panels to each other.

An additional object of the invention is to provide a method which ensures that the dimensions of various flaps, tucks and overlapping portions are the same on each and every one of a short or long series of successive deformed panels which are caused to confine discrete block-shaped commodities.

Still another object of the invention is to provide a method which renders it possible to rapidly shift from the draping of commodities having a first format to the draping of commodities having a different second format.

A further object of the invention is to provide a method which renders it possible to carry out the entire wrapping operation while the commodities are in continuous motion.

An additional object of the invention is to provide a novel and improved apparatus which can be utilized for the practice of the above outlined method.

A further object of the invention is to provide the apparatus with novel and improved girth wrapping assembly.

Another object of the invention is to provide the apparatus with novel and improved means for squaring successive commodities prior to draping into discrete panels of wrapping material.

A further object of the invention is to provide the apparatus with novel and improved means for folding and tucking certain portions of panels during draping around the respective commodities.

Still another object of the invention is to provide an apparatus which can be converted to process differently dimensioned commodities within a fraction of the time that is required to change the setup of a conventional apparatus.

A further object of the invention is to provide a novel and improved mechanism for manipulating panels of wrapping material ahead of the wrapping station proper.

Another object of the invention is to provide novel and improved panel folding instrumentalities for use in the above outlined apparatus.

An additional object of the invention is to provide the apparatus with novel and improved means for adjusting the folding, tucking and other instrumentalities when a series of commodities having a first height is followed by a series having a different second height.

A further object of the invention is to provide the apparatus with novel and improved means for advancing commodities toward, through and beyond the wrapping station or stations.

Another object of the invention is to provide the apparatus with novel and improved means for automatically converting successive flat panels of wrapping material into elongated tubes.

SUMMARY OF THE INVENTION

One feature of the present invention resides in the provision of a method of draping stacks of sheets or analogous substantially block-shaped commodities into wrapping material of paper or the like. The method comprises the steps of advancing a series of successive commodities in a predetermined direction along a predetermined path wherein each commodity has normally relatively narrow front, rear and lateral sides and normally wider top and bottom sides, introducing successive panels of wrapping material into a predetermined portion of the path so that the bottom side of each commodity comes to rest on and advances with a discrete panel and each panel has front, rear and lateral portions extending beyond the corresponding sides of the respective commodity, folding the rear portions of successive panels upwardly against the rear sides and forwardly against the top sides of the respective commodities, folding the front portions of successive panels upwardly against the front sides and rearwardly against the top sides of the respective commodities, and bonding the folded front and rear portions of the panels to each other at the top sides of the respective commodities.

The method preferably further comprises the step of applying a film of adhesive to one of the front and rear portions of each panel prior to completion of the respective folding step. One of the folding steps then comprises causing one of the folded front and rear portions of each panel to overlap the other of the folded front and rear portions at the top side of the respective commodity with the adhesive disposed between the overlapping front and rear portions.

The method preferably further comprises the step of squaring the commodities in a second portion of the path ahead of the predetermined portion. Such squaring step preferably includes moving the lateral sides of successive commodities into two predetermined parallel planes, placing at least one yieldable abutment or stop into the path for engagement by the front sides of successive commodities while the lateral sides of such commodities are maintained in or at least close to the two predetermined planes, and withdrawing the at least one abutment or stop from the path when the stop is engaged by the front side of an oncoming commodity of the series. The at least one abutment or stop can be moved along an arcuate path partly counter and partly in the predetermined direction.

The method can further comprise the steps of establishing and maintaining a supply (e.g., a roll) of coherent panels of wrapping material, withdrawing successive foremost panels from the supply, changing (if necessary) the orientation of successive foremost panels outside of the predetermined portion of the path so that successive reoriented panels advance in the predetermined direction, and separating successive foremost panels from the next-following panels.

The method further comprises the step of tucking and folding the portions of successive panels against the adjacent lateral sides of the respective commodities downstream of the predetermined portion of the path.

As mentioned above, the folding steps include causing the folded front portion of each panel to overlie the folded rear portion of the respective panel or vice versa, and the method preferably further comprises the step of pressing the overlapping folded front and rear portions of each panel against each other and against the top side of the respective commodity to promote the setting of adhesive between the overlapping folded front and rear portions.

The method preferably further comprises the steps of maintaining successive commodities of the series at a predetermined distance from each other (as seen in the predetermined direction), squaring successive commodities of the series ahead of the predetermined portion of the path, and tucking and folding the portions of successive panels against the adjacent lateral sides of the respective commodities downstream of the predetermined portion of the path.

The step of folding the front portions of successive panels can include attracting the front portions to a folding member by suction, and lifting the thus attracted front portions and the folding member relative to the path so that the front portions extend transversely of the path and are engaged and folded by the oncoming commodities.

Another feature of the invention resides in the provision of an apparatus for draping stacks of sheets or analogous substantially block-shaped commodities into wrapping material of paper or the like. The improved apparatus comprises means for advancing a series of successive commodities in a predetermined direction along a predetermined path wherein each commodity normally has relatively narrow front, rear and lateral sides and normally wider top and bottom sides, means for introducing successive panels of wrapping material into a predetermined portion of the path so that the bottom side of each commodity comes to rest on and advances with a discrete panel and each panel which is disposed beneath a commodity has front, rear and lateral portions extending beyond the corresponding sides of the respective commodity, a first folding unit having means for folding the rear portions of successive panels upwardly against the rear sides and forwardly against the top sides of the respective commodities, and a second folding unit having means for folding the front portions of successive panels upwardly against the front sides and rearwardly against the top sides of the respective commodities.

The apparatus preferably further comprises means for applying adhesive to one of the front and rear portions of each panel. The means for folding the front and rear portions of the panels are designed to cause the folded front and rear portions of each panel to overlap at the top side of the respective commodity with the adhesive disposed between and bonding the overlapping front and rear portions to each other.

The apparatus preferably further comprises means for squaring successive commodities of the series in a second portion of the path upstream of the predetermined portion. The squaring means preferably comprises means (e.g., two plates or boards which are movable toward and away from each other transversely of the predetermined path) for shifting the lateral sides of successive commodities into predetermined parallel vertical planes extending in the predetermined direction, at least one abutment or stop which is movable into the path to be engaged by the front side of an oncoming commodity while the lateral sides of such commodity are located in or close to the two predetermined planes, and means for moving the at least one abutment or stop into the predetermined path for engagement by an oncoming commodity and from the path in response to engagement of the at least one abutment by a commodity. The squaring means ensures that each commodity overlies a predetermined central portion of the respective panel so that each panel which is disposed beneath a commodity has front, rear and lateral portions of predetermined size (it being assumed here that the dimensions of all panels which are used for the wrapping of a series of identical commodities are the same). The means for moving the at least one abutment or stop preferably comprises means for moving the at least one abutment or stop back and forth along an arcuate second path substantially in and counter to the predetermined direction.

The folding means of the first folding unit comprises a carriage, means for moving the carriage in and counter to the predetermined direction along a second path adjacent the predetermined path, a plurality of folding elements (e.g., in the form of substantially C-shaped fingers) mounted on the carriage, and means for pivoting the folding elements into and away from engagement with the rear portions of successive panels about an axis which extends substantially transversely of the two paths. The carriage is reciprocated at such a speed that the folding elements can catch up with an advancing panel to fold the rear portion of such panel first against the rear side and thereupon against the top side of the advancing commodity which is located ahead of the folding elements. Each folding element can be provided with a yieldable (e.g., spring biased) panel-engaging portion. The means for advancing the commodities can comprise a plurality of endless conveyors which are spaced apart from each other. as seen transversely of the predetermined direction, and define a plurality of gaps extending in the predetermined direction. Each folding element is pivotable in one of the gaps.

The folding means of the second folding unit can comprise a folding member which extends transversely of the path and has means for attracting the leaders of oncoming front portions of successive panels. The folding member is movable between a lower position in which it attracts the oncoming leader and a raised position above the predetermined path so that the respective front portion then extends across the predetermined path and is folded against the front and top sides of the respective commodity as a result of advancement of the commodity in the predetermined direction. The folding means of the second folding unit further comprises means for moving the folding member between its lower and raised positions. The attracting means can include suction ports in the folding member. The latter can include a row of substantially L-shaped folding sections. The advancing means can comprise a plurality of endless conveyors which define a plurality of gaps extending in the predetermined direction, and each section of the folding member is movable up and down in one of the gaps. The apparatus can further comprise means for selecting the level of the folding member in at least one of its positions.

The apparatus preferably further comprises a source of a series of coherent panels adjacent the predetermined path, and the introducing means then comprises means for withdrawing successive foremost panels of the series from the source and means for separating successive withdrawn foremost panels from the next-following panels of the series. The introducing means can further comprise means for changing the orientation of successive foremost panels of the series between the source and the predetermined path. This is necessary if the direction of withdrawal of panels from the source does not coincide with the direction of advancement of commodities along their path.

The apparatus further comprises means for tucking and folding the portions of successive panels against the adjacent lateral sides of the respective commodities in a further portion of the path downstream of the predetermined portion. The tucking and folding means comprises two movable tucking members, one for each lateral side of a commodity in the predetermined path, and two stationary combined tucking and folding members. Each movable tucking member can comprise a panel-engaging portion of variable height, and each combined tucking and folding member preferably also comprises a panel-engaging portion of variable height.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 4 is a schematic view, partly as seen in the direction of arrows from the line IV–IV of FIG. 3, showing the manner of advancing a succession of panels from a source of panels into the path of advancement of reams through the girth wrap station;

FIG. 5 is a fragmentary plan view of the mechanism which squares successive reams ahead of the girth wrap station;

DESCRIPTION OF PREFERRED EMBODIMENTS

Figure 1A:
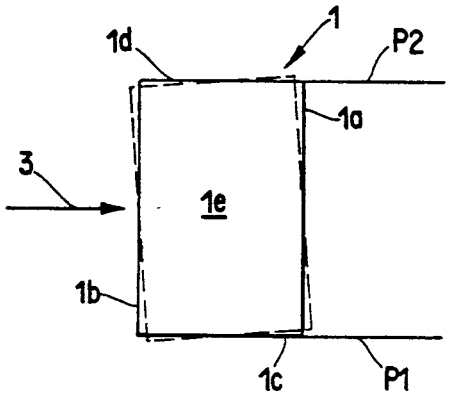
FIGS. 1*a* and 1*e* are plan views showing a ream and a panel during different stages of conversion of the panel into an envelope which surrounds the ream.

The steps of the improved method will be described first with reference to FIGS. 1*e*–1*e* and 2*a*–2*g*. These Figures shown one of a series of preferably equidistant substantially block-shaped commodities 1 (hereinafter called reams or folio reams for short) which are continuously advanced in the direction of arrow 3. The reference character 2 denotes a panel of paper or other wrapping material which is to be draped around the respective ream 1 in accordance with the improved method to ultimately form an envelope 2A (FIGS. 1*e* and 2*g*) which completely and tightly surrounds the respective ream 1.

Figure 2A:
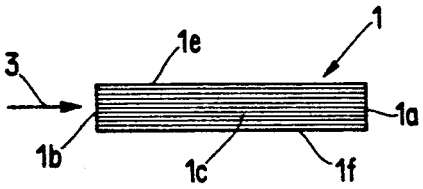
FIGS. 2*a* to 2*g* are side elevational views showing the stages of conversion of the panel into an envelope.

FIGS. 1*a* and 2*a* show a ream 1 at a so-called squaring station (shown at 10 in FIG. 3) where the position of the ream with reference to its advancing unit (shown at 6 in FIG. 3) is changed (if necessary) in order to ensure that the bottom side or surface 1*f* of the ream will come to rest on a predetermined central portion of the respective panel 2. The squaring involves a shifting of the ream 1 so that its relatively narrow lateral sides 1*c* and 1*d* are moved into two parallel planes P1, P2 extending in the direction (arrow 3) of advancement of the ream. Furthermore, the ream 1 can be shifted counter to the direction of arrow 3 by at least one stop or abutment which enters the path of the ream and is thereupon retracted in response to engagement by the front side 1*a* of the ream.

Figure 1B:
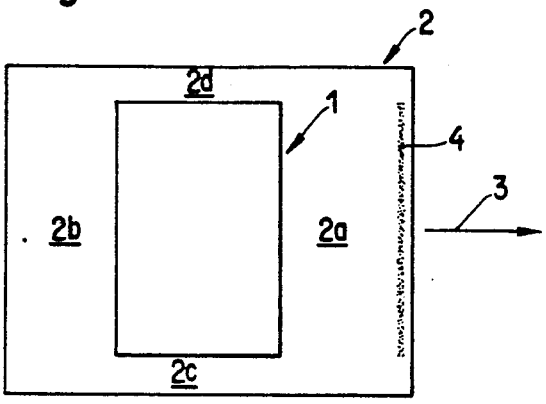
Figure 2B:
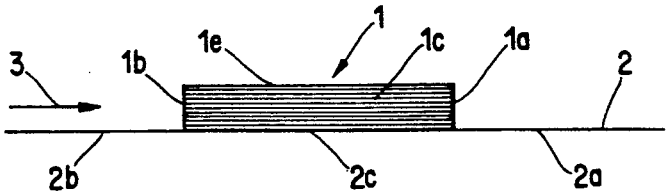
Figure 2C:
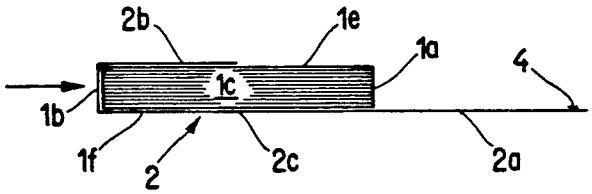

The panel 2 is fed into the path of movement of the ream 1 from below and advances with the ream in the direction of arrow 3. FIGS. 1*b* and 2*b* show the ream 1 on the central portion of the panel 2 whereby the front portion 2*a*, the rear portion 2*b* and the lateral portions 2*c*, 2*d* extend beyond the respective sides 1*a*, 1*b*, 1*c*, 1*d* of the ream 1. The bottom side 1*f* of the ream 1 contacts the median portion of the panel 2 and the top or upper side 1*e* of the ream 1 is accessible. The upper side of the leader of front portion 2*a* of the panel 2 carries a layer or film 4 of suitable adhesive, e.g., a hot melt.

Figure 1C:
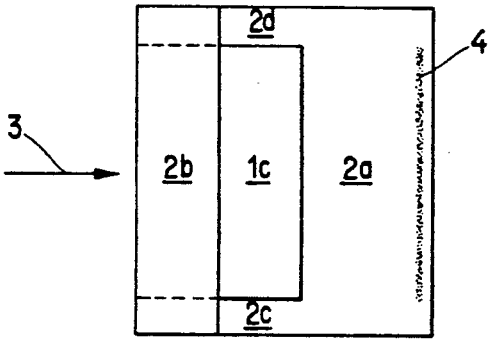
Figure 1D:
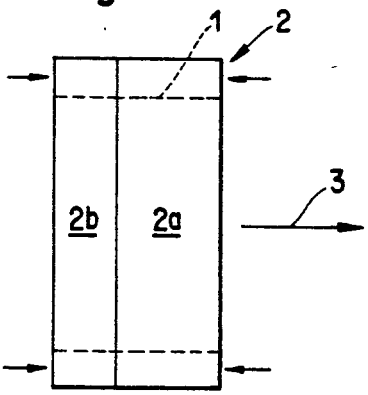
Figure 2D:
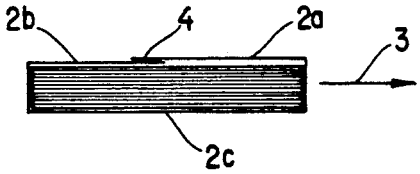

The next step involves folding the rear portion 2*b* of the panel 2 first upwardly against the rear side 1*b* and thereupon forwardly against the rear portion of top side 1*e* of the ream 1. This can be seen in FIGS. 1*c* and 2*c*. The front portion 2*a* of the panel 2 is thereupon folded in a manner as shown in FIGS. 1*d* and 2*d*, i.e., first upwardly against the front side 1*a* and thereupon rearwardly against the top side 1*e* of the ream 1 whereby the leader of the front portion 2*a* overlies the adjacent transversely extending marginal zone of the folded rear portion 2*b*. The adhesive film 4 is disposed between and bonds the overlapping zones of the folded portions 2*a*, 2*b* to each other. This completes the girth wrapping operation. The panel 2 is transformed into a flat tube having a rectangular cross-sectional outline and being open at both ends, i.e., the tube does not overlie the lateral sides 1*c*, 1*d* of the partially confined ream 1.

Figure 1E:
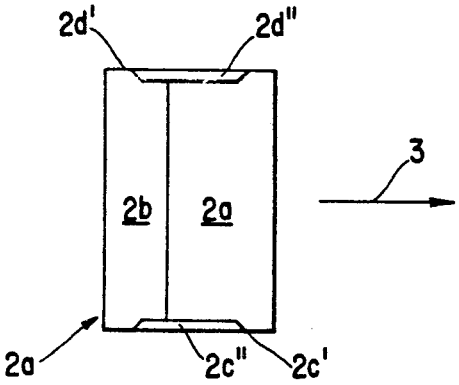
Figure 2E:
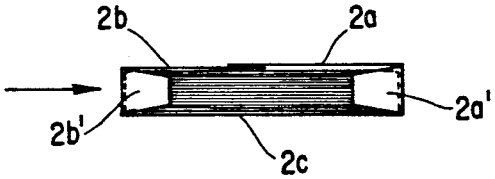
Figure 2F:
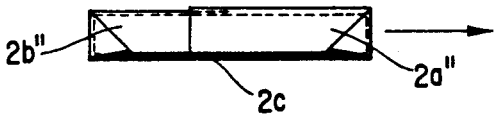
Figure 2G:
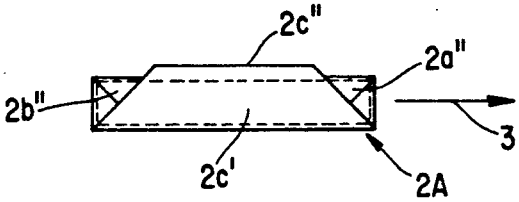

The next steps involve conversion of lateral zones of folded front and rear portions 2*a*, 2*b* into pairs of tucks 2*a*', 2*b*' (one pair is shown in FIG. 2*e*), into a pair of flaps 2*a*''+2*b*'' (one of these flaps is shown in FIG. 2*f*), and into a pair of flaps 2*c*', 2*d*' (both shown in FIG. 1*e* and one shown in FIG. 2*g*). This completes the conversion of the panel 2 into an envelope 2A. It goes without saying that at least the free marginal zones of the lateral portions 2*c*, 2*d* are provided with films of adhesive (e.g., hot melt) so as to ensure that the flaps 2*c*', 2*d*' overlie the respective flaps 2*a*''+2*b*'' and that the tips 2*c*'', 2*d*'' (FIG. 1*e*) of the flaps 2*c*', 2*d*' adhere to the exposed side of the folded front portion 2*a*.

The making of tucks 2*a*', 2*b*' involves folding the respective zones of the portions 2*a*, 2*b* against the adjacent lateral sides 1*c*, 1*d* preferably in such a way that the two tucks 2*b*' are formed prior to the two tucks 2*a*'. When the making of the tucks 2*a*', 2*b*' is completed, each flap 2*a*''+2*b*'' is folded downwardly over the respective pair of tucks 2*a*', 2*b*, and each of the two flaps 2*c*', 2*d*' is thereupon folded upwardly over the respective flaps 2*a*''+2*b*'' to complete the combined tucking and flap forming and folding operation. If the flaps 2*a*''+2*b*'' are too long, their tips are first folded over the upper sides of the respective lateral portions 2*c*, 2*d* and are thereupon folded again (with the respective marginal portions 2*c*, 2*d*) to overlie the adjacent portions of the respective pairs of tucks 2*a*', 2*b*'. By the same token, and as shown in FIGS. 1*e* and 2*g*, if the flaps 2*c*', 2*d*' are too long, their tips 2*c*'', 2*d*'' are caused to overlie and to be bonded to the exposed side of the folded front portion 2*a*.

It is presently preferred to form the girth (the region of overlap of the folded front and rear portions 2*a*, 2*b*) nearer to the rear side 1*b* than to the front side 1*a* of the ream 1. For example, the distance of the adhesive film 4 from the rear side lb can be one-half the distance of the adhesive film from the front side 1*a* of the ream 1.

It is clear that the sequence of folding the front and rear portions 2*a*, 2*b* of the panel 2 can be altered so that the leader of the folded front portion 2*a* is overlapped by the foremost zone of the folded rear portion 2*b*. The illustrated sequence of folding the front and rear portions 2*a*, 2*b* is preferred at this time, primarily because it is possible to use the folding member for the front portion 2*a* as a means for pressing or ironing the leader of the front portion 2*a* and the adhesive film 4 against the overlapped zone of the folded rear portion 2*b* while the ream 1 continues to advance in the direction of the arrow 3.

Figure 3:
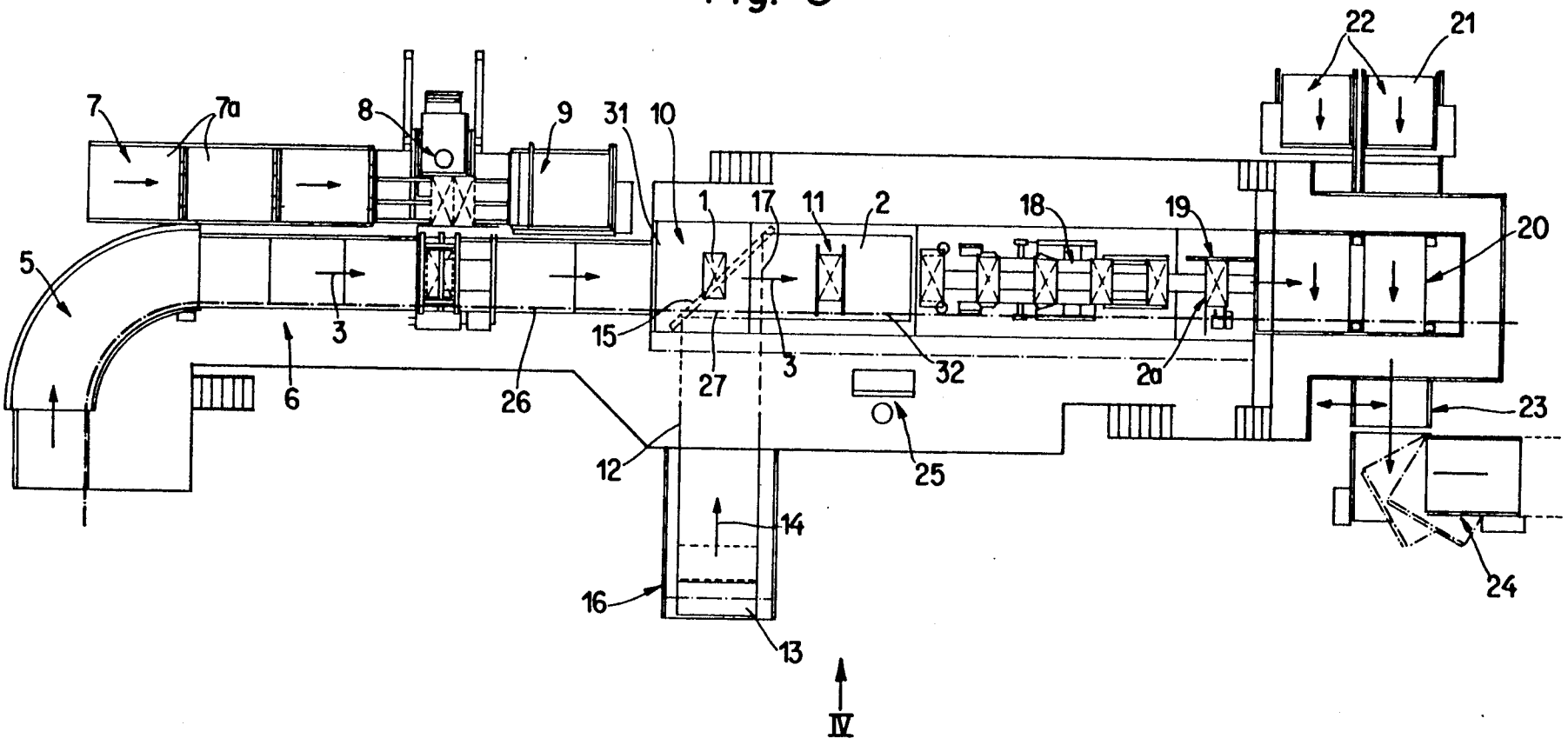
FIG. 3 is a schematic plan view of an apparatus which embodies one form of the invention.

FIG. 3 is a plan view of a presently preferred apparatus which embodies the improved ream squaring, girth wrapping, tucking and folding assemblies. The apparatus comprises a ream infeeding unit 5 which serves to deliver a series of discrete reams 1 onto an advancing unit 6 including a series of successive conveyors to be described hereinafter. The apparatus further comprises a skid accepting unit 7 for individual skids 7*a* which can be of the type supplied by a ream/skid discharge folio sheeter known as FFS 195 (produced by E. C. H. Will GmbH of Hamburg, Federal Republic Germany). The unit 7 delivers complete skids 7*a* to an automatic or semiautomatic unstacker 8. Successive reams 1 can be individually removed from the foremost skid 7*a* and accurately placed on the adjacent conveyor of the advancing unit 6 by means of servo motors in a manner not forming part of the present invention. Empty skids 7*a* are moved to a skid restacker 9 for transport back to the folio sheeter. All conveyors preferably have individual AC variable-speed controllers for accurate acceleration and deceleration.

A ream 1 which is delivered by the infeeding unit 5 or by the unstacker 8 is advanced to a squaring and indexing station 10 and thence into the automatic girth wrap station 11. As this is taking place, a continuous web 12 of coherent panels 2 is being advanced from a bobbin or reel 13 or another suitable source first in the direction of arrow 14 and thereupon in the direction of arrow 3. The means for changing the direction of advancement and orientation of the web 12 through an angle of 90 degrees comprises a deflecting roller 15 which is installed beneath the path of movement of the reams 1 on the conveyors of the ream advancing unit 6. The bobbin or reel 13 is mounted on a multiple bobbin or reel unwind stand 16. The web 12 is repeatedly severed by a rotary knife 17 so that it yields a series of successive panels 2. The girth wrap station 11 is followed by an end folding station 18 wherein successive panels 2 of the series of panels are treated in a manner as shown in FIGS. 1*e* and 2*e*–2*g*. The thus obtained products 1+2A are advanced to a hot melt ream labeler 19 (e.g., Model 74-HM which is distributed by the assignee of the present application) and thence into an automatic palletizer 20 (e.g., Model 153 distributed by the assignee of the present application) which receives discrete pallets 21 from hoppers 22. Loaded pallets 21 are accepted by a shuttle conveyor 23 which delivers such pallets to a turning conveyor 24. The latter conveys loaded pallets 21 to the shipping area.

An enclosed pressurized hot melt glue system is employed for both the girth seals at the girth wrap station 11 and the end seals at the end folding station 18.

Controls for all functions of the improved apparatus are located at an operator station 25. This station accommodates a so-called "Smartscreen" color graphics operator interface, e.g., a device having a 256K memory with screens available to give the operator step-by-step instructions and diagnostics using text, graphics and visuals. Other screens show all machine alarms and the emergency stop button locations. An additional screen shows system production in reams per minute, reams per hour and web speed in feet per minute. The operator can preprogram this system with, for example, the five highest volume sizes which permits him to automatically change over from one of these ream sizes to another by the simple expedient of pushing a button. Other ream sizes can be preprogrammed while the apparatus is running to thus further reduce the time which is required for a changeover.

The apparatus employs a counting device which sequences all of the operations involved in girth wrapping a ream. Each ream 1 is assigned a number count in the controlling computer. Although the apparatus can employ and presently employs only one counter for a substantial number of reams, the computer maintains a separate numeric value for each individual ream and updates each value for every count produced by the counter. By way of example, the first ream of a series of reams can have a count value of 20 and a second ream entering the apparatus at 5 or 8 can be given a value of 0. When the counter produces a count, the computer at 25 updates each value making the first ream's value 21 and the second ream's value 1.

When a ream 1 enters the apparatus, it advances on the belts of a tape conveyor 26 forming part of the advancing unit 6 and causes the generation of a signal by blocking an optoelectronic detector, such as an electric eye. This starts the counter when the trailing edge of the ream 1 advances beyond the beam of radiation from the radiation source of the detector. Based on information which is entered by the operator during set up, the computer calculates and adjusts the sequence to accommodate reams of various sizes.

The belts of a tape conveyor 26 at the inlet end of the apparatus advance successive reams 1 of the series of reams onto a flight conveyor 27 of the advancing unit 6. The movements of the flight conveyor 27 are initiated by signals from the counter. Due to limitations of the computer, the count value for each ream 1 must be reset to zero once during the cycle of the respective ream through the apparatus. Such resetting to zero takes place when the computer receives a signal which shows that a flight of the flight conveyor 27 departed from its home or starting position. The flights of the conveyor 27 are timed in such a way that they achieve prependicularity to the conveying surface immediately behind the adjacent reams 1 and push the reams off the tape conveyor 26 without the ream moving in relation to the tapes of the tape conveyor.

The flight conveyor 27 of the advancing unit 6 pushes successive reams 1 through the squaring station 10. The purpose of instrumentalities at the squaring station 10 is to ensure the squareness of each ream 1 in vertical and latitudinal directions of the apparatus. This is accomplished by moving a pair of lateral squaring boards 28 (one shown in FIG. 5), one at each side of the path of advancement of reams 1 in the direction of arrow 2, simultaneously from the respective sides toward the center line of the apparatus. The stopping point of each board 28 in a direction toward the center line is calculated by a computer on the basis of information entered by the operator during set up. The boards 28 are maintained in positions at a minimum distance from each other (so that their inner sides are located in the planes P1 and P2 (of FIG. 1*a*) while a flight (or a set of aligned flights) of the conveyor 27 pushes a ream 1 by engaging its rear side 1*b* until the front side la of such ream comes in contact with a pair of abutments or stops 29 (one shown in FIG. 5) in the form of small boards, one at each lateral side (1*c*, 1*d*) of the ream 1. Each abutment 29 is movably secured to the respective board 28 by a set of links 30 constituting a parallel motion mechanism. Actual engagement of the front side 1*a* of a ream 1 with at least one of the abutments 29 is sensed by an optoelectronic or electromechanical detector 31 which transmits to the computer a signal serving to initiate a return movement of the boards 28 to their retracted positions at a maximum distance from each other and from the center line of the apparatus. The same signal serves to initiate a movement of the respective abutment 29 from the path of a ream 1. The bottom panel 31 (FIG., 3) at the squaring station 10 is provided with ports (not shown) which discharge jets of air so as to cause the bottom sheet of a ream 1 advancing through the station 10 to float on a cushion of air. Such "air tables" are well known and are often used in paper sheet processing machines. Floating of a ream 1 during travel through the squaring station 10 facilitates the task of the boards 28 in moving the lateral sides 1*c*, 1*d* of each ream 1 into the respective planes P1 and P2.

The directions of movement of the abutment or stop 29 are indicated by a double-headed arrow 29*a*. It will be noted that this abutment has components of movement in and counter to the direction indicated by arrow 3. This enables the links 30 to rapidly move the abutment 29 into and from the path of movement of the reams 1. The other board 28 and the other abutment 29 are mirror images of the parts 28, 29 which are shown in FIG. 5.

The flights of the flight conveyor 27 of the advancing means 6 push successive squared or aligned reams 1 onto another tape belt conveyor 32 of the unit 6, and such conveyor advances the reams 1 through the girth wrap station 11 which follows the squaring station 10 and precedes the end folding station 18.

While a ream 1 advances through the squaring station 10, a paster 33 (FIG. 4) applies the film 4 of adhesive to the leading edge of the web 12, i.e., to the leader of the front portion 2*a* of the foremost sheet 2 of a succession of coherent sheets 2 which together form the web 12. The adhesive film 4 is hot glue which is applied by a glue nozzle 34 of the paster 33, and such glue nozzle 34 traverses across the path for the reams 1 from one side to the other. The arrangement is preferably such that the nozzle 34 applies the film 4 only to a portion of the leader of the web 12, namely to a portion having a length corresponding to the width of a ream 1 (i.e., the distance of the lateral surface 1*c* from the lateral surface 1*d*).

The web 12 is fed from the roll on the bobbin or reel 13 in the stand 16 between two knives 17A which have trimming blades and are disposed at opposite sides of the path of advancement of the web 12 toward the path of advancement of the reams 1. The mutual spacing of the knives 17A is determined by the dimensions of the reams 1 and is selected in such a way that the width of each separated panel 2 is properly related to the width (i.e., the distance between the lateral sides 1*c* and 1*d*) of the ream 1 which is to come to rest on the panel 2.

The knives 17A are preceded by a conventional accumulator 90, e.g., an accumulator including a fixed arm with a first set of rollers and a pivotable arm with a second set of rollers. From the accumulator 90, the web 12 advances into the path of movement of the reams 1 by entering such path from below through a series of rollers. On its way from the trimming knives 17A to the girth wrap station 11, the web 12 is acted upon by the adjustable deflecting roller 15 which is positioned at an angle of 45 degrees to the direction indicated by arrow 3 to bisect the angle formed by the directions indicated by the arrows 3 and 14. Thus, the roller 15 changes the direction of movement of the web 12 by 90 degrees so that the direction of movement of the reoriented web 12 coincides with the direction of movement of the respective ream 1 toward and through the girth wrap station 11. By adjusting the position of the deflecting roller 15 relative to the station 11, one can change the location and/or inclination of the roller to thus steer the web 12 to correct latitudinal locations prior to feeding onto the surface of the tape conveyor 32 at the station 11. The web 12 is engaged by feed rollers 35 which advance it past the orbiting blades of a knife 17 above a stationary counterknife 17*a* and onto a vacuum tape conveyor 36 which conveys it to a position beneath the hot glue paster or gun 33.

The feed rollers 35 for the web 12 and the blades of the knife 17 receive motion from a prime mover by way of discrete clutches which are turned on and off by the computer in response to signals from the aforementioned counter. The computer calculates the timing of advancement of panels 2 to ensure that each of a short or long series of reams 1 comes to rest on a predetermined central portion of the respective panel 2. The girth wrapping operation begins as soon as a ream 1 overlies the predetermined portion of the respective panel 2.

Figure 6:
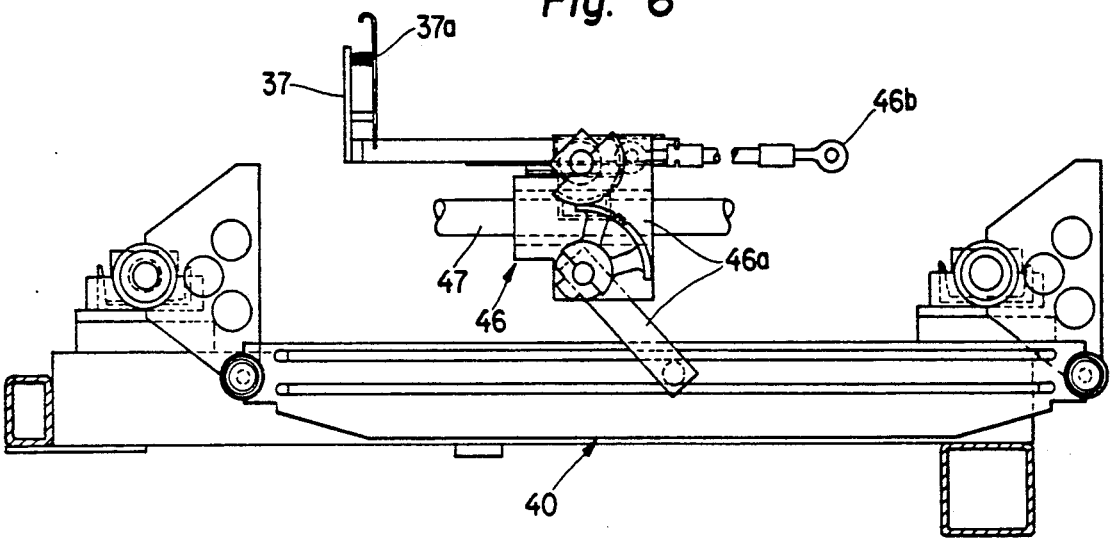
FIG. 6 is a fragmentary side elevational view of a first folding unit which is located at the girth wrap station and serves to fold the rear portions of successive panels.

The mechanism at the girth wrap station 11 comprises three major assemblies or units, namely a first unit having a set of folding elements in the form of fingers 37 (one shown in FIG. 6) which fold the rear portions 2*b* of successive panels 2, a second unit including a folding member 38 (FIG. 7) composed of a transversely extending row of substantially L-shaped sections 39 which serve to fold the front portions 2*a* of successive panels 2, and a third unit including a compression roller which presses the adhesive-coated zone or leader of each folded front portion 2*a* against the adjacent zone of the respective folded rear portion 2*b*. This promotes the establishment of a reliable bond between the folded portions 2*a*, 2*b* of each panel 2. The movements of all three assemblies or components of the mechanism at the girth wrap station 11 are controlled by the computer by way of two engageable and disengageable clutches.

The folding fingers 37 of the first unit serve to lift the rear portions 2*b* of successive panels 2 and to fold them first against the rear sides 1*b* and thereupon against the top sides 1*e* of the respective reams 1. The means for moving the folding fingers 37 of the first unit includes two cams 40 (one shown in FIG. 6) one of which pivots the fingers 37 from a level beneath the tape conveyor 32 at the station 11 through the gaps between the vacuum tapes. The other cam causes the fingers 37 to traverse behind the ream 1, i.e., to push the rear portions 2*b* of successive panels 2 forwardly to the positions corresponding to that of the rear portion 2*b* shown in FIGS. 1*c* and 2*c*. The fingers 37 are pivotable about a common horizontal axis extending at right angles to the path for the reams 1. Each folding finger 37 has a yieldable (spring biased) panel-engaging portion 37*a*. These folding fingers are pivotable in gaps between the belts of the tape conveyor 32.

The folding member 38 of the second unit attracts the leader of each front portion 2*a* and holds it against further movement in the direction of arrow 3. The remainder of the panel 2 continues to advance toward the end folding station 18, the same as the major part of the panel, so that the front side la of the ream 1 engages and deforms the raised and arrested front portion 2*b* as a result of continued movement in the direction of arrow 3.

Figure 7:
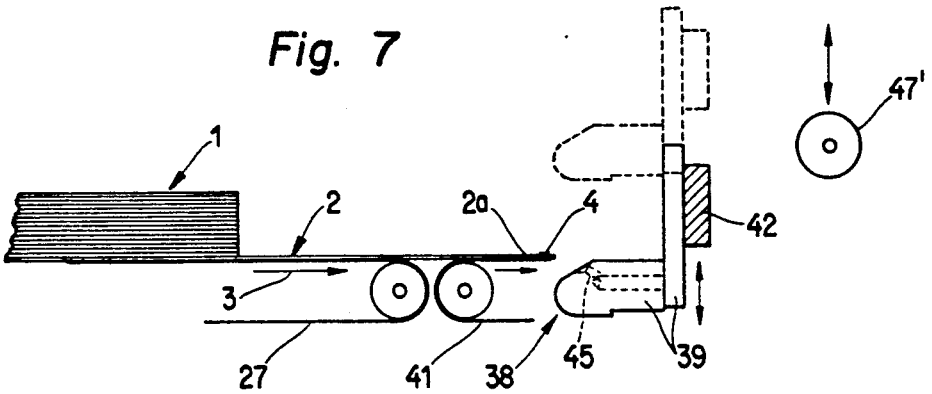
FIG. 7 is a fragmentary side elevational view of a second folding unit which is also located at the girth wrap station and serves to fold the front portions of successive panels.

The sections 39 of the composite folding member 38 forming part of the second girth wrap unit are initially located at a level beneath the path of movement of the panel 2 at the station 11 (see FIG. 7). Such sections are aligned with the gaps between the bands of a further tape conveyor 41 at the station 11. Such gaps extend in the direction of arrow 3. A bar 42 carries the sections 39 of the folding member 38 and extends transversely of the path of movement of the reams 1 toward the station 18. This bar serves as a means for moving the sections 39 between raised and lower positions. When the front side 1*a* of a ream 1 reaches a position close to the lowered sections 39 of the folding member 37, a so-called wrap spring clutch is energized for a short interval of time to pivot an arm 43 (FIG. 8) which, in turn, has two arms 44 and 49' mounted to it. These arms 43 and 49' lift the sections 39 of the folding member 38 partially above the path of the panel 2. A third cam, driven by the clutch which transmits motion to the aforementioned cams for the folding fingers 37 of the first unit, rotates the arm 44 which receives motion from the wrap spring clutch to thus move the sections 39 of the folding member 38 to their raised or uppermost positions. Each section 39 of the folding member 38 has one or more suction ports 45 (FIG. 7) which serve to attract the leading edge of the panel 2 opposite the adhesive film 4. Suction in the ports 45 of the sections 39 is generated by compressed air passing through an orifice into a larger passage. When in fully raised positions, the folding sections 39 are located at a level above the path of advancement of the reams 1 so that each ream can advance beneath the leader of the respective front portion 2*a* and can fold such front portion first against its front side 1*a* and thereupon against its top side 1*e* so that the film 4 overlies the foremost zone of the already folded rear portion 2*b*.

The arrangement is preferably such that the folding fingers 37 of the first unit push the ream 1 slightly in a forward direction when the folding of the rear portion 2*b* against the rear side 1*b* and the top side le of the respective ream 1 is completed. In other words, at least the speed of last stage of movement of the folding fingers 37 with their carriage 46 (FIG. 6) along guide rods 47 in the direction of arrow 3 exceeds the speed of forward movement of reams 1 through the station 11. Such difference between the speed of the folding fingers 37 and the reams 1 causes each ream to bear against the raised and arrested front portion 2*a* and to ensure that the thus folded front portion 2*a* closely follows the outlines of the front side la and top side 1*e* of the respective ream. The sections 39 of the folding member 38 forming part of the second unit are then lowered to move the film 4 of adhesive against the upper side of the front zone of the already folded rear portion 2*b* of the panel 2. As the ream 1 continues to advance in the direction of arrow 3, the folded front portion 2*a* advances with the ream, i.e., relative to the sections 39 of the folding member 38, so that the portion 2*a* slides relative to the sections 39 and these sections smooth or iron the adhesive-coated leader of the portion 2*a*. The aforementioned cam causes the member 38 to descend to a position in which the weight of the sections 39 suffices to iron out the overlap between the folded portions 2*a* and 2*b*. The sections 39 of the folding member 38 are free to continue their return movement to the lower positions of FIG. 7 beneath the path of movement of panels 2 through the station 11 as soon as the ream 1 and the tube (converted panel 2) advance beyond the bar 42 for the folding member 38. A detector can be used to generate a signal when a partially draped panel 2 (in a state as shown in FIGS. 1*d* and 2*d*) advances beyond a predetermined portion of the station 11, and such signal is used to energize the wrap spring clutch to pivot the respective arm 43 so that the folding member 38 of the second unit is returned to the lower position of FIG. 7.

The compression roller 47' (FIG. 7) of the girth wrap mechanism serves to completely seal the girth seam, i.e., the seam which is formed by the adhesive film 4. This compression roller 47' is located immediately downstream of the folding member 38 and is operated by the same cam. The arrangement is such that the compression roller 47' is lifted with the sections 39 of the folding member 38. A pneumatic cylinder and piston unit 48 (FIG. 8) forms part of the linkage for the compression roller 47' and serves to ensure that the compression roller 47' is located at a level above the upper side le of the oncoming ream 1 while the sections 39 of the folding member 38 carry out the aforediscussed ironing or smoothing step. The cylinder and piston unit 48 is thereupon caused to lower the compression roller 47' into actual engagement with the exposed surface of folded front portion 2*a* of the panel 2.

The folding fingers 37 of the first unit at the girth wrap station 11 are reciprocable along at least two guide rods 47 between front and rear end positions. They are caused to catch up with the ream 1 in front of them subsequent to pivoting of the rear portion 2*b* of the respective panel 2 along the edge between the sides 1*b* and 1*f* of the ream so that they actually push the ream and the properly folded (inverted L-shaped) rear portion 2*b* forwardly in order to ensure that the front portion 2*a* of the panel will be tightly draped around the front side 1*a* and the top side 1*e* of the ream while the leader of the front side 2*a* is attracted by suction ports 45 of the folding sections 39 forming part of the folding member 38. At such time, the bar 42 maintains the folding member 38 in the raised position indicated in FIG. 7 by broken lines.

The exact details of the mechanism 46*a* (shown in FIG. 6) which serves to pivot the folding fingers 37 about a horizontal axis extending transversely of the path of advancement of the reams 1 forms no part of the present invention. It suffices to say that such mechanism can pivot the folding fingers 37 between first positions beneath the path of movement of successive panels 2 and a second position in which the yieldable portions 37*a* of the fingers 37 bear against the exposed surface of the folded rear portion 2*b* of the adjacent panel 2. The member 46*b* of FIG. 6 establishes an operative connection between the carriage 46 and a cam which serves to reciprocate the carriage between its two (front and rear) end positions.

Figure 8:
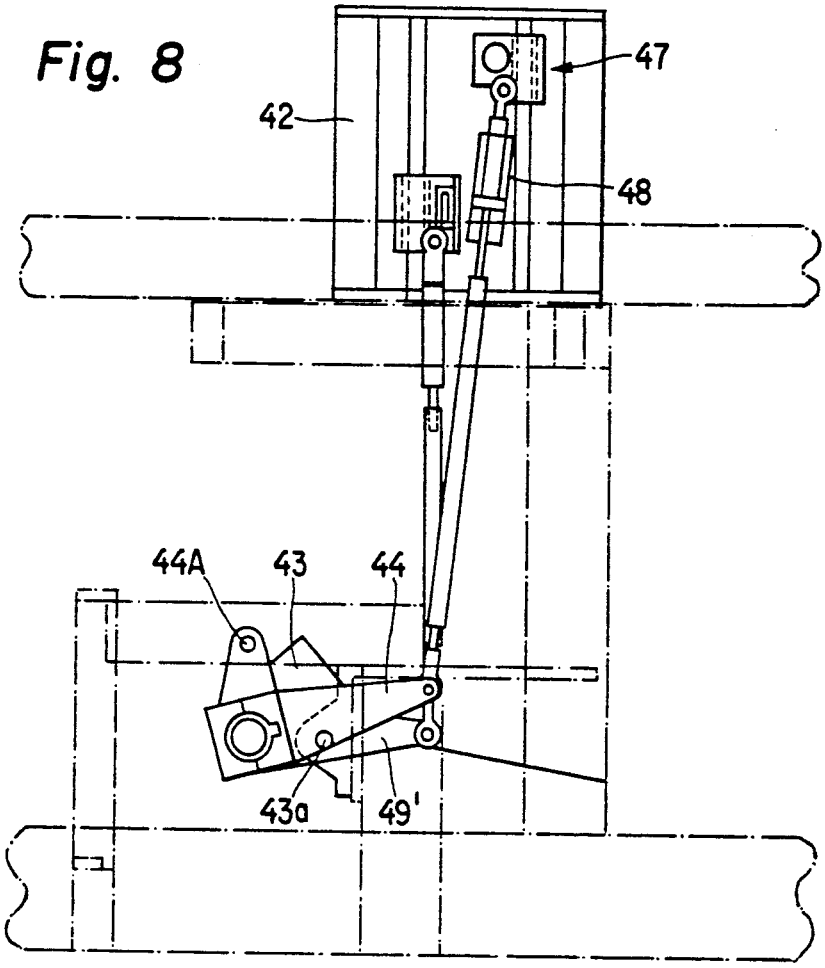
FIG. 8 is a fragmentary side elevational view of the mechanism which serves to move the folding member of the second folding unit and a compression roller behind the folding member.

The mechanism of FIG. 8 serves to raise and lower the bar 42 for the folding member 38 and the compression roller 47' in synchronism with movements of the panels 2 and the respective reams 1 in the direction of arrow 3. The lever 43 is pivotable about a fixed fulcrum 43*a* and receives motion from the aforementioned wrap spring clutch. The levers 44 and 49' are pivotable about a point located on the lever 43 and receive motion from suitable cams (e.g., from groove cams which are not specifically shown in FIG. 8). The locus of operatively connecting one of the levers 44, 49' with a cam by means of an arm carrying a suitable follower is shown at 44A.

The mechanism of FIG. 8 is further designed to compensate for differences in the height of successive series of reams 1. Actuation of the arm 43 is triggered by the aforediscussed wrap spring clutch.

The mode of operation of the mechanism at the end folding station 18 is analogous to that of the mechanism which is disclosed in U.S. Pat. No. 3,213,591 to Feurstein et al. The disclosure of this patent is incorporated herein by reference. The difference between the mechanisms of Feurstein et al. and the mechanism at the end folding station 18 of the apparatus which is shown in FIG. 3 is that the height of the movable tucking members 49 is adjustable from the operator station 25 to conform to the height of reams 1, and that the height of the stationary tucking members 50 is also adjustable to conform to the height of the reams which are being wrapped.

Figure 9:
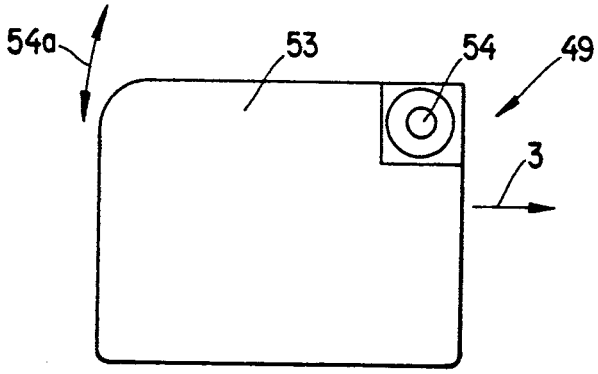
FIG. 9 is a plan view of one of the two movable tucking members at the end folding station of the apparatus which is shown in FIG. 3.
Figure 10:
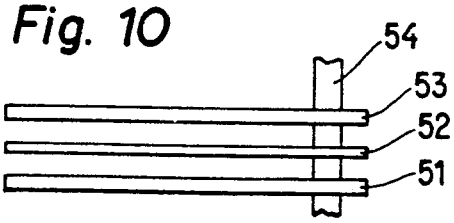
FIG. 10 is a side elevational view of the tucking member which is shown in FIG. 9.

Each movable tucking member 49 has three plates 51, 52, 53 (FIGS. 9–10) mounted on an upright pivot member 54. In order to form a rear tuck 2*b'* (FIG. 2*e*), the plates 51, 52, 53 jointly pivot about the axis of the member 54 in the direction of arrow 54*a* and simultaneously move in the direction of arrow 3. If the height of a fresh series of reams 1 exceeds the height of the preceding series of reams, the operator at the station 25 moves the plates 52, 53 away from the plate 51 (the level of the late 51 is normally fixed) and/or the plate 53 away from the plate 52 to thus increase distance of the upper side of the plate 53 from the underside of the plate 51. The exact design of the mechanism for moving the plates 52, 53 relative to each other and/or relative to the plate 51 forms no part of the invention. For example, the topmost plate 53 can be mounted for movement between three different levels, and the plate 52 can be mounted for movement between two different levels.

Figure 11:
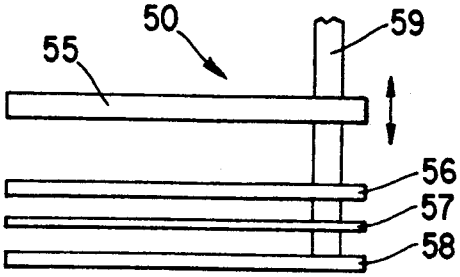
FIG. 11 is a side elevational view of one of two stationary combined tucking and flap folding members at the end folding station.

Each stationary tucking member 50 (FIG. 11) serves to form the respective tucks 2*a'* as well as the respective flaps 2*a''*+2*b''* and 2*c'* or 2*d'*. The flaps are or can be folded in the same way as disclosed in the patent to Feurstein et al. In order to take into consideration the differences between the heights of successively wrapped series of reams 1, the upper section 55 of each member 50 is movable up and down with the plate 56 and/or 57 of the composite lower section. The latter further includes a third plate 58 the level of which is fixed. The reference character 59 denotes one of the guides for the upper section 55 and for the plates 56, 57 of the lower section.

It is clear that the tucking members 49 and/or the members 50 are adjustable in directions toward and away from the longitudinal center line of the apparatus.

An important advantage of the improved apparatus is its versatility. The apparatus can readily manipulate reams with formats ranging between 20 and 52 inches in length, between 14 and 38 inches in width and between $\frac{5}{8}$ and $3\frac{1}{2}$ inches in height. Moreover each change of setup can be completed within a very short interval of time, normally between 3 and 14 minutes. The weight of reams can be as high as 100 lbs., and the paper weight can range between 60 and 230 gm/m$^2$. The presently preferred material of the panels 2 is glue-sealable kraft and kraft laminates normally stored on cores having a diameter of $2\frac{3}{4}$ or 3 inches. The multiple roll stand 16 can accommodate two, four or even more reels or can be replaced with a stand for a single reel. If the space beneath the squaring and girth wrap stations 10, 11 suffices, the source of panels 2 can be placed beneath these stations so that it is possible to dispense with the deflecting roller 15 and to simplify the design of the mechanism which introduces successive panels 2 into the path of advancement of the reams 1 from the infeeding unit 5 or from the unstacker 8. A roll lift mechanism can be supplied with the stand 16 to facilitate the deposition of fresh reels 13. The illustrated four-roll turret style unwind stand 16 can be furnished with slitters which remove excess material to reduce inventory of overwrap material. As mentioned above, the stand 16 can be replaced or used interchangeably with single and double stands.

The apparatus is centerline adjustable for product length and is preferably furnished with mezzanine platforms at both sides of the stations 10, 11 and 18.

The mechanism 28–30 at the squaring and indexing station 10 ensures that each and every one of a short or long series of reams 1 is properly positioned with reference to the respective panel 2 in order to ensure the making of a desired number of identical envelopes 2A.

The drive for the web 12 is preferably a so-called wrapper roll tension brake mechanism.

The construction of the palletizer 20, pallet hoppers 22, shuttle conveyor 23 and turning conveyor 24 is or can be the same as in certain presently available earlier types of wrapping apparatus. Therefore, the details of the devices 20 and 22–25 are not shown in the drawing. Other types of collecting and transporting means for wrapped reams 1 can be used with equal or similar advantage.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for draping stacks of sheets or analogous block-shaped commodities into wrapping material, comprising conveyor means for advancing a series of successive commodities in a predetermined direction along a predetermined path wherein each commodity has front, rear, lateral, top and bottom sides; means for introducing successive panels of wrapping material into a predetermined portion of said path so that the bottom side of each commodity comes to rest on and advances with a discrete panel and each panel has front, rear and lateral portions extending beyond the corresponding sides of the respective commodity; means for squaring successive conveyor-advanced commodities of said series in a second portion of said path upstream of said predetermined portion, including means for shifting the lateral sides of successive commodities into predetermined planes, at least one abutment movable into said path to be engaged by the front side of an oncoming conveyor-advanced commodity while the lateral sides of the commodity are located in or close to said planes, and means for moving said at least one abutment into said path for engagement by an oncoming commodity and from said path in response to engagement of the abutment by a conveyor-advanced commodity so that the commodities need not come to a halt in the second portion of said path; a first folding unit having means for folding the rear portions of successive panels upwardly against the rear sides and forwardly against the top sides of the respective commodities; and a second folding unit having means for folding the front portions of successive panels upwardly against the front sides and rearwardly against the top sides of the respective commodities; said folding means of said first unit comprises a carriage, means for moving said carriage in and counter to said direction along a second path adjacent said predetermined path, a plurality of folding elements mounted on said carriage, and means for pivoting said elements into and away from engagement with the rear portions of successive panels about an axis extending substantially transversely of said paths; said folding means of said second unit comprises a plurality of T-shaped folding members extending transversely of said path and having suction means for attracting the leaders of oncoming front portions of successive panels, said members being movable between a lower position in which they attract the oncoming leader and a raised position above said path so that the respective front portion extends across said path and is folded against the front and top sides of the respective commodity as a result of advancement of the commodity in said direction, and means for moving said members between said lower and raised positions; said conveyor means includes a plurality of endless, parallel conveyors spaced apart from each other transversely of said direction and defining a plurality of gaps extending in said direction, each of said folding members and elements being movable up and down in said gaps.

2. The apparatus of claim 1, further comprising means for applying adhesive to one of the front and rear portions, said folding means being operative to cause the folded front and rear portions of each panel to overlap at the top side of the respective commodity with the adhesive disposed between and bonding the front and rear portions to each other.

3. The apparatus of claim 1, wherein said moving means comprises means for moving said at least one abutment back and forth along an arcuate second path substantially in and counter to said predetermined direction.

4. The apparatus of claim 1, wherein each of said folding elements has a yieldable panel-engaging portion.

5. The apparatus of claim 1, further comprising means for selecting the level of said folding member in at least one of said lower and raised positions.

6. The apparatus of claim 1, further comprising a source of a series of coherent panels adjacent said path, said introducing means including means for withdrawing successive panels of said series from said source and means for separating successive withdrawn foremost panels from the next-following panels of said series.

7. The apparatus of claim 6, wherein said introducing means further comprises means for changing the orientation of successive foremost panels of said series between said source and said path.

8. The apparatus of claim 1, further comprising means for tucking and folding said portions of successive panels against the adjacent lateral sides of the respective commodities in a second portion of said path downstream of said predetermined portion.

9. The apparatus of claim 8, wherein said tucking and folding means includes two movable tucking members and two stationary combined tucking and folding members.

10. The apparatus of claim 9, wherein each of said movable tucking members includes a panel-engaging portion of variable height.

11. The apparatus of claim 9, wherein each of said combined tucking and folding members comprises a panel-engaging portion of variable height.

12. The apparatus of claim 1, wherein said conveyor means includes means for exerting a pushing force against the rear sides of commodities at least in said second portion of said path.

* * * * *